US007488708B2

(12) United States Patent
Deljosevic et al.

(10) Patent No.: US 7,488,708 B2
(45) Date of Patent: Feb. 10, 2009

(54) FOAMING TWO-COMPONENT HARD SURFACE CLEANING COMPOSITIONS

(75) Inventors: Vesna Deljosevic, Cincinati, OH (US); Robert Zhong Lu, Montvale, NJ (US); Carolyn Martinez, Montvale, NJ (US); Albert Thomas Weibel, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 64 days.

(21) Appl. No.: 11/456,321

(22) Filed: Jul. 10, 2006

(65) Prior Publication Data

US 2006/0276366 A1 Dec. 7, 2006

(30) Foreign Application Priority Data

Jan. 17, 2004 (GB) ..... 0401071.6

(51) Int. Cl.

| | |
|---|---|
| ***C11D 1/75*** | (2006.01) |
| ***C11D 3/39*** | (2006.01) |
| ***C11D 3/395*** | (2006.01) |
| ***C11D 7/06*** | (2006.01) |
| ***C11D 7/08*** | (2006.01) |

(52) U.S. Cl. ..... 510/238; 510/235; 510/239; 510/240; 510/367; 510/372; 510/375; 510/379; 510/406; 510/503

(58) Field of Classification Search ..... 510/235, 510/238, 239, 240, 367, 372, 375, 379, 406, 510/503

See application file for complete search history.

(56) References Cited

U.S. PATENT DOCUMENTS

| | | | | |
|---|---|---|---|---|
| 3,729,553 | A | 4/1973 | Gold et al. | |
| 3,760,986 | A | 9/1973 | Castner et al. | |
| 3,786,963 | A | 1/1974 | Metzler, III | |
| 4,355,739 | A | 10/1982 | Vierkotter | |
| 4,826,048 | A | 5/1989 | Skorka et al. | |
| 4,902,281 | A | 2/1990 | Avoy | |
| 4,949,874 | A | 8/1990 | Fiedler et al. | |
| 5,009,342 | A | 4/1991 | Lawrence et al. | |
| 5,152,461 | A | 10/1992 | Proctor | |
| 5,154,917 | A | 10/1992 | Ibrahim et al. | |
| 5,252,312 | A | 10/1993 | Gentile et al. | |
| 5,289,950 | A | 3/1994 | Gentile | |
| 5,332,157 | A | 7/1994 | Proctor | |
| 5,339,990 | A | 8/1994 | Wilder | |
| 5,385,270 | A | 1/1995 | Cataneo et al. | |
| 5,439,141 | A | 8/1995 | Clark et al. | |
| 5,472,119 | A | 12/1995 | Park et al. | |
| 5,560,545 | A | 10/1996 | Grogan et al. | |
| 5,562,250 | A | 10/1996 | O'Neill | |
| 5,626,259 | A | 5/1997 | Maas et al. | |
| 5,887,761 | A | 3/1999 | Foster et al. | |
| 5,934,515 | A | 8/1999 | Bennett | |
| 5,964,377 | A | 10/1999 | Demarest et al. | |
| 6,479,444 | B1 * | 11/2002 | Porticos et al. | 510/195 |
| 2003/0199411 | A1 * | 10/2003 | Ajamani et al. | 510/195 |

FOREIGN PATENT DOCUMENTS

| | | | |
|---|---|---|---|
| CA | 2306283 | A1 | 2/2000 |
| EP | 479451 | A2 | 4/1992 |
| EP | WO 98/33880 | * | 8/1998 |
| EP | 875460 | A1 | 11/1998 |
| EP | 979782 | A1 | 2/2000 |
| JP | 59164399 | A | 9/1984 |
| WO | 9505327 | A1 | 2/1995 |
| WO | 98/33880 | A | 8/1998 |

OTHER PUBLICATIONS

International Preliminary Report on Patentability dated Jul. 27, 2006 for application PCT/GB2005/000164.

Combined Search and Examination Report from The Patent Office in Great Britain dated Jul. 12, 2004 for application GB 0401071.6.

WPI Abstract Acc. No. 1984-267236 [43] & JP 59164399 A (Lion Corp) see WPI Abstract, Sep. 17, 1984.

International Search Report dated Apr. 5, 2005 for application PCT/GB2005/000164.

Written Opinion of the International Searching Authority for Application PCT/GB2005/000164, Apr. 5, 1005.

English language abstract for CA2306283 obtained online from esp@cenet, Feb. 24, 2000.

English language abstract for EP0875460 obtained online from esp@cenet, Nov. 4, 1998.

English language abstract for EP0979782 obtained online from esp@cenet, Feb. 16, 2000.

English language abstract for WO9505327 obtained from esp@cenet, Feb. 23, 1995.

* cited by examiner

*Primary Examiner*—Brian P Mruk

(74) *Attorney, Agent, or Firm*—Norris McLaughlin & Marcus, PA

(57) ABSTRACT

Foamed two-part hard surface treatment composition which is formed by the admixture of two aqueous compositions, particularly (a) an aqueous alkaline composition comprising a bleach constituent, with (b) an aqueous acidic composition comprising a peroxide constituent, which compositions are kept separate, but which are admixed immediately prior to use or upon use to form a foamed hard surface treatment composition. The foamed two-part hard surface treatment composition are particularly useful in the cleaning of hard surfaces. Preferred foamed two-part hard surface treatment composition provide both a cleaning and sanitizing or disinfecting benefit to hard surfaces, while releasing little or no free chlorine gas to the ambient air.

12 Claims, No Drawings

FOAMING TWO-COMPONENT HARD SURFACE CLEANING COMPOSITIONS

This is an application filed under 35 USC 371 of PCT/GB2005/000164.

The present invention relates to hard surface treatment compositions containing bleach. More particularly the present invention relates to hard surface treatment compositions which are formed from two components which are admixed immediately prior to use or upon use which hard surface treatment compositions contain bleach and which are useful in the cleaning treatment and/or disinfection or sanitization treatment of hard surfaces.

Hard surface cleaning and disinfecting compositions are well known and widely used in providing a cleaning and disinfecting effect to surfaces, particularly hard surfaces. Many known art compositions of this type are largely aqueous in nature and are provided either as a concentrate intended to be diluted into a larger volume of water, or may be used as supplied directly from the package or container. The use of oxygen bleaches in compositions for has been known and many such compositions are available. However a common difficulty in formulating such a composition is to ensure that aqueous compositions containing oxygen bleaches remain stable during storage, especially during longer durations, and following such storage still retains a significant amount of activity. For example, while certain peroxygen bleach containing compositions are known, many require either the inclusion of expensive stabilizing constituents or complex processes for the production of such compositions, or both, in order to improve their storage stability. Typically peroxygen bleach containing compositions require a pH of less than about 6 in order to ensure the long term storage stability of the compositions. In contrast, hypohalite bleaches require a pH of about 12 or greater in order to ensure the long term storage stability of compositions comprising these materials. The formulation of shelf stable products which comprise good storage stability, while at the same time comprise a peroxygen bleach such as $H_2O_2$, and a hypohalite bleach is particularly difficult to a achieve. Such difficulties are further exacerbated when such products are also intended to be used in the removal of limescale from hard surfaces, particularly lavatory surfaces, kitchens surfaces and the like as effective limescale removal often requires the application of a strongly acidic composition (e.g., pH<3, preferably pH of about 2 or less) to dissolve limescale deposits from surfaces. The inclusion of further constituents in such product formultions e.g., surfactants, dyestuffs, fragrances, thickeners, raises further technical complexities.

Certain two-part formulations are nevertheless known to the art which formulations are supplied in two separate liquid compositions which are intended to be mixed immediately prior to, or only upon use.

U.S. Pat. No. 6,479,444 B1 describes a foaming drain cleaning composition formed by admixing two liquids which are kept separate prior to use. The first liquid preferably contains a hypohalite or a hypohalite generating constituent, while the second liquid preferably contains a peroxygen agent such that when an admixture of the first and second liquid is formed the interaction of the liquids generates oxygen gas and causes foaming of the admixture composition.

"BREF WC Duo-Power Gel" (ex. Henkel) is a commercially available hard surface treatment composition which is presently commercially available in Germany, which comprises two liquid compositions each provided in separate chambers of a dual-chamber bottle which two liquid compositions exiting the bottle are intermixed at a dispensing nozzle to form a mixed hard surface treatment composition.

While such known art compositions find certain utility there nonetheless remains a real need in the art for improved bleach containing hard surface treatment compositions, particularly for bleach containing two-component liquid cleaning compositions which find use in the treatment of hard surfaces. It is to this need as well as to further needs that the present invention is directed.

According to a first aspect of the invention there is provided a two-part hard surface treatment composition which is formed by the admixture of two aqueous compositions, particularly (a) an aqueous alkaline composition comprising a bleach constituent, with (b) an aqueous acidic composition comprising a peroxide constituent, which compositions are kept separate, but which are admixed immediately prior to use or upon use to form a foamed hard surface treatment composition, which may be at a pH in the range of about 1 to about 12. Each of the aqueous alkaline composition and the aqueous acidic compositions may include one or more further optional constituents which may improve the aesthetic characteristics, or which may improve one or more functional features of the inventive compositions, and these may be present in effective amounts. When present such further optional constituents need be compatible with the remaining constituents forming either the (a) aqueous alkaline composition or the (b) aqueous acidic compositions of the inventive compositions. Particularly useful are optional constituents which improve the foam forming and/or hard surface cleaning characteristics and/or product stability or handling characteristics of the two-part hard surface treatment composition taught herein. In preferred embodiments of the formed two-part hard surface treatment composition taught herein provide both a cleaning benefit also with a disinfecting or sanitizing benefit to treated hard surfaces.

According to a second aspect of the invention there is provided a method for the treatment of hard surfaces, which process contemplates the step of:

providing a two-part hard surface treatment composition which is formed by the admixture of two aqueous compositions, particularly (a) an aqueous alkaline composition comprising a bleach constituent, with (b) an aqueous acidic composition comprising a peroxide constituent as well as a chlorine control constituent, which are kept separate, but which are admixed immediately prior to use or upon use to form a foamed hard surface treatment composition;

applying the foamed hard surface treatment composition to a hard surface in need of cleaning or disinfecting or sanitizing treatment in an amount effective to accomplish such a purpose; and, optionally, rinsing the foamed hard surface treatment composition from the treated hard surface.

According to a third aspect of the invention there is provided in a container having at least two-compartments and a dispensing means comprising:

a quantity of (a) an aqueous alkaline composition comprising a bleach constituent contained in a first compartment;

a quantity of (b) an aqueous acidic composition comprising a peroxide constituent in a second compartment; and, dispensing means adapted to dispense the contents (or parts thereof) of the first and second compartments onto a surface either sequentially or simultaneously to form a mixture of the (a) an aqueous alkaline composition with the (b) an aqueous acidic composition thereof resulting in a foamed hard surface treatment composition.

Compositions suitable for carrying out the invention are provided as separate components suitable for mixing by the consumer. Where the compositions are suitable for mixing they may be mixed either directly at the surface or remote from the surface before application.

In use, the (a) aqueous alkaline composition with the (b) aqueous acidic composition are admixed not more than 3 minutes, preferably within 90 seconds, yet more preferably within about 20 seconds, still more preferably within about 10 seconds, and most preferably within about 3 seconds before being applied to a hard surface requiring treatment. According to particularly preferred embodiments of the invention, the mixing of the (a) aqueous alkaline composition with the (b) aqueous acidic composition causes the rapid formation of a foamed hard surface treatment composition which provides a durable foam which remains in a foamed form for at least 3 minutes, preferably for at least 5 minutes, and most preferably for at least 10 minutes after mixing and application onto a hard surface.

In accordance with the invention, (a) aqueous alkaline composition may be mixed with the (b) aqueous acidic composition in any suitable proportions, depending upon their initial concentrations, suitably such that the ultimately formed admixture applied mixture comprises from about 0.01 to about 30% w/w of active oxygen. Preferably, the volumetric ratio or weight ratios of (a) aqueous alkaline composition to (b) aqueous acidic composition is from 10:1 to 1:10, yet more preferably a ratio in the range of from 2:1 to 1:2, still more preferably in a ratio of from 1.5:1 to 1:1.5, and most preferably the (a) aqueous alkaline composition and the (b) aqueous acidic composition are mixed in substantially equal parts.

The (a) aqueous alkaline compositions of the hard surface treatment compositions necessarily include as the bleach constituent at least one an oxidizing agent based on a hypohalite or a hypohalite generating constituent, for example one or more constituents selected from the group consisting of the alkali metal and alkaline earth salts of hypohalite, haloamines, haloimines, haloimides and haloamides. All of these are believed to produce hypohalous bleaching species in situ. Preferably, the oxidizing agent is a hypohalite or a hypohalite generator capable of generating hypohalous bleaching species. It is to be understood that the term "hypohalite" is used to describe both a hypohalite or a hypohalite generator, unless otherwise indicated. Preferably, the hypohalite oxidizing agent is a hypochlorite or a generator of hypochlorite in aqueous solution, although hypobromite or a hypobromite generator is also suitable. Representative hypochlorite generators include sodium, potassium, lithium, magnesium and calcium hypochlorite, chlorinated trisodium phosphate dodecahydrate, potassium and sodium dichloroisocyanurate and trichlorocyanuric acid. Organic bleach sources suitable for use include heterocyclic N-bromo and N-chloro imides such as trichlorocyanuric and tribromocyanuric acid, dibromocyanuric acid and dichlorocyanuric acid, and potassium and sodium salts thereof, N-brominated and N-chlorinated succinimide, malonimide, phthalimide and naphthalimide. Also suitable are hydantoins, such as dibromodimethyl-hydantoin and dichlorodimethyl-hydantoin, chlorodimethylhydantoin, N-chlorosulfamide (haloamide) and chloramine (haloamine). More preferably, the bleach constituent is an alkali metal hypochlorite, an alkaline earth salt of hypochlorite, or a mixture thereof. A particularly preferred bleach constituent useful in the present inventive composition is sodium hypochlorite which is widely available and technically effective. While the bleach constituent may be present in any amount effective to provide satisfactory bleaching of hard surfaces, advantageously the bleach constituent is present in amounts of from 0.1-10% wt, preferably 0.05-5% wt., and most preferably about 1-3% wt. of the (a) aqueous alkaline composition of which it forms a part.

The (a) aqueous alkaline compositions of the hard surface treatment compositions include an alkaline constituent which functions as a source of alkalinity for the (a) aqueous alkaline compositions. Preferably the alkaline constituent is selected from the group consisting of a hydroxides, a hydroxide generators, buffers, and a mixtures thereof. Exemplary alkaline constituents include alkali metal salts of various inorganic acids, such as alkali metal phosphates, polyphosphates, pyrophosphates, triphosphates, tetraphosphates, silicates, metasilicates, polysilicates, borates, carbonates, bicarbonates, hydroxides, and mixtures of same. A particularly preferred alkaline constituent is an alkali metal hydroxide, especially sodium hydroxide. The alkaline constituent may be included in the (a) aqueous alkaline compositions in any amount which is effective in adjusting or maintaining the pH of 11 or more, preferably a pH of 12 or more, and most preferably a pH of 13 or more. While the alkaline constituent may be present in any effective amount to adjust and/or maintain a desired pH, advantageously the alkaline constituent forms 0.1-5% wt., preferably 0.5-3% wt., and most preferably 1-2% wt. of the (a) aqueous alkaline compositions of which they form a part.

In certain preferred embodiments the alkaline constituent may comprise or consist of gas releasing constituent which generates $CO_2$ gas in the presence of an acid. The reaction of the gas releasing constituent causes the evolution of bubbles of gas from a liquid as the result of a chemical reaction, e.g., between an acid source (which is present in the (b) aqueous acidic compositions of the inventive compositions) and the gas releasing constituent, to produce carbon dioxide gas which in turn contributes to the foaming of the formed hard surface treatment compositions. Such a gas releasing constituent is interchangeably referred to as a $CO_2$ donor constituent and may be present in the absence of a further alkaline constituent which does not generate $CO_2$ gas when mixed with an aqueous acid composition. Known art materials can be used as the gas releasing constituent including one or more materials selected from the group consisting of carbonates, bicarbonates, sesquicarbonates, and mixtures thereof, preferably as alkali metal containing compounds. Non-limiting examples of suitable bases include sodium carbonate, potassium carbonate, magnesium carbonate, calcium carbonate, ammonium carbonate, sodium bicarbonate, potassium bicarbonate, magnesium bicarbonate, calcium bicarbonate, ammonium bicarbonate, sodium sesquicarbonate, potassium sesquicarbonate, magnesium sesquicarbonate, calcium sesquicarbonate, ammonium sesquicarbonate, and mixtures thereof. Preferably, the gas releasing constituent is selected from sodium carbonate, sodium bicarbonate and mixtures thereof.

A representative reaction is as follows:

$$NaHCO_3/Na_2CO_3+H+\rightarrow CO_2$$

From the foregoing, a gas releasing constituent reacts with the acid to form carbon dioxide gas. The evolution of carbon dioxide gas is advantageous in the formation of the foam formed by the intermixture of the (a) aqueous alkaline composition with the (b) aqueous acidic composition.

The gas releasing constituent may be present in any effective amount which provides effective generation of carbon dioxide gas when the (a) aqueous alkaline compositions and (b) aqueous acidic compositions are intermixed; it is to be understood that the amount of the gas releasing constituent present may vary due to factors such as the particular gas releasing constituent(s) selected, as well as the selection and quantity of acid(s) present in (b) aqueous acidic compositions which react with the gas releasing constituent to generate carbon dioxide gas. Advantageously the gas releasing constituent forms 0.1-8% wt., preferably 0.5-5% wt. of the (a) aqueous alkaline compositions of the inventive compositions.

It is also to be understood that the gas releasing constituent if present in sufficient amounts, may also function in replacing all or part of the alkaline constituent also necessarily present in the (a) aqueous alkaline compositions of the inventive compositions. In such case, the total amount of the gas releasing constituent may be increased to additionally include the amount of the alkaline constituent indicated above as the gas releasing constituent present is expected to function as both providing alkalinity to the (a) aqueous alkaline compositions as well as in reacting with the acid present in the (b) aqueous acidic compositions to release carbon dioxide upon mixing of the (a) aqueous alkaline compositions and (b) aqueous acidic compositions. Desirably the $CO_2$ donor component is contained in the (a) aqueous alkaline compositions which is maintained under alkaline conditions which conditions are also beneficial to the long term storage stability of a hypohalite or a hypohalite generating constituent which may be used as the bleach constituent in the (a) aqueous alkaline compositions.

It has surprisingly been found that the amount of the gas releasing constituent present in the (a) aqueous alkaline compositions, particularly where such is a sodium carbonate, sodium bicarbonate or mixture thereof has a significant influence on the ultimate pH of the mixture formed from the (a) aqueous alkaline compositions and (b) aqueous acidic compositions when mixed. Minor adjustments in the amount of the gas releasing constituent has been observed to often have a large influence on the ultimate pH of the mixture compositions formed. According to preferred embodiments of the invention, the gas releasing constituent is necessarily present and yet more preferably is present only in sufficient amounts such that the final pH of the mixture formed from the (a) aqueous alkaline compositions and (b) aqueous acidic compositions is desirably at a pH of less than about 4, preferably about 3 or less, and most preferably has a pH of about 2.5 or less. Particularly preferred compositions according to the invention, and amounts of the gas releasing constituent are described with reference to one or more of the examples.

According to certain preferred embodiments of the (a) aqueous alkaline compositions both an alkaline constituent and a separate gas releasing constituent are present, as disclosed with reference to one or more of the examples.

The (a) aqueous alkaline compositions of the hard surface treatment compositions taught herein further optionally but most desirably further comprise one or more detersive surfactants which provide a beneficial cleaning benefit to treated hard surfaces. Examples of the major surfactant types that can be used to carry out the present invention include, inter alia; alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates, ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, as well as mixtures thereof.

Any surfactants, when present in the inventive compositions, may be included in either the (a) aqueous alkaline compositions or the (b) aqueous acidic compositions or both, it being required only that the selected surfactants provide cleaning effectiveness when the hard surface treatment compositions taught herein are formed, and that they are relatively stable within the respective (a) aqueous alkaline compositions or the (b) aqueous acidic compositions of which they form a part.

In preferred embodiments of the invention, the (a) aqueous alkaline compositions comprise a nonionic surfactant, especially one or more amine oxide compounds which provide a cleaning benefit to treated hard surfaces, and which aid in the generation of a foam when the (a) aqueous alkaline compositions and the (b) aqueous acidic compositions are mixed together. Exemplary useful amine oxide compounds include one or more which may be described in one or more of the following of the four general classes:

(1) Alkyl di(lower alkyl)amine oxides in which the alkyl group has about 6-24, and preferably 8-18 carbon atoms, and can be straight or branched chain, saturated or unsaturated. The lower alkyl groups include between 1 and 7 carbon atoms, but preferably each include 1-3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl(hydrogenated tallow)amine oxide, and myristyl/palmityl dimethyl amine oxide;

(2) Alkyl di(hydroxy lower alkyl)amine oxides in which the alkyl group has about 6-22, and preferably 8-18 carbon atoms, and can be straight or branched chain, saturated or unsaturated. Examples include bis-(2-hydroxyethyl)cocoamine oxide, bis-(2-hydroxyethyl)tallowamine oxide; and bis-(2-hydroxyethyl)stearylamine oxide;

(3) Alkylamidopropyl di(lower alkyl)amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and (4) Alkylmorpholine oxides in which the alkyl group has about 10-20, and preferably 12-16 carbon atoms, and can be straight or branched chain, saturated or unsaturated.

While these amine oxides recited above may be used, preferred are amine oxides which may be represented by the following structural representation:

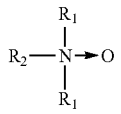

wherein each $R_1$ independently is a straight chained $C_1$-$C_4$ alkyl group; and, $R_2$ is a straight chained $C_6$-$C_{22}$ alkyl group or an alkylamidoalkylene having the formula

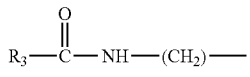

where $R_3$ is $C_5$-$C_{20}$ alkyl or $$—(CH_2)_p—OH$$

where n is 1 to 5 and p is 1 to 6; additionally, $R_2$ or $R_3$ could be ethoxylated (e.g., 1 to 10 moles EO/mol) or propoxylated (e.g., 1 to 10 moles of PO/mol).

Each of the alkyl groups may be linear or branched, but most preferably are linear. Examples include AMMONYX LO which is described to be as a 30% wt, active solution of lauryl dimethyl amine oxide; AMMONYX CDO Special, described to be a about 30% wt. active solution of cocoamidopropylamine oxide, as well as AMMONYX MO, described to be a 30% wt. active solution of myristyldimethylamine oxide.

When present the amine oxide surfactant constituent desirably forms 0.1-3% wt., preferably 0.2-2% wt., and most preferably 0.3-1% wt. of the (a) aqueous alkaline compositions.

According to certain preferred embodiments of the invention, the sole surfactant present in the inventive compositions are nonionic surfactants, especially one or more amine oxide surfactants.

According to certain further preferred embodiments, any surfactants present in the inventive compositions are present only within the (a) aqueous alkaline compositions of the hard surface treatment compositions taught herein.

The (b) aqueous acidic compositions of the inventive compositions comprise, peroxide which may be provided as hydrogen peroxide or as a peroxyhydrate or other material which releases hydrogen peroxide in aqueous solution. Such materials are per se, known to the art. Examples of such materials and compounds include without limitation: alkali metal peroxides including sodium peroxide and potassium peroxide, alkali perborate monohydrates, alkali metal perborate tetrahydrates, alkali metal persulfate, alkali metal percarbonates, alkali metal peroxyhydrate, alkali metal peroxydihydrates, and alkali metal carbonates especially where such alkali metals are sodium or potassium. Further useful are various peroxydihydrate, and organic peroxyhydrates such as urea peroxide. As noted previously the peroxide in the (b) aqueous acidic compositions reacts with the oxidizing agent to generate oxygen gas when the (a) aqueous alkaline compositions and (b) aqueous acidic compositions are mixed together to form the foamed hard surface cleaning compositions taught herein. It is to be understood that the amount of the peroxide present in the (b) aqueous acidic compositions may vary due to including the type and the quantity of the oxidizing agent present in (a) aqueous alkaline compositions which necessarily react with the peroxide in order to generate oxygen gas. Advantageously the peroxide is present in amounts of 0.1-10% wt., preferably 0.5-5% wt. and especially preferably 0.3-1% wt. of the (b) aqueous acidic compositions according to the invention.

When the (a) aqueous alkaline compositions comprise as the bleach constituent a hypohalite or a hypohalite generating constituent, such as sodium hypochlorite, and when the (b) aqueous acidic compositions comprise a peroxide, their intermixing permits for the reaction of the bleach constituent with the peroxide present in the (b) aqueous acidic composition. An example of such a reaction is indicated by the following:

$$NaOCl+H_2O_2 \rightarrow NaCl+H_2O+O_2$$

As is seen from the foregoing, the reaction results in the generation of water, sodium chloride (when the oxidizing agent is the preferred sodium hypochlorite) and oxygen gas. The generation of oxygen gas advantageously contributes to the foaming of the formed hard surface treatment compositions.

The (b) aqueous acidic compositions of the inventive compositions also necessarily include an acid constituent. As noted previously the acid constituent reacts with the gas generating constituent upon mixing of the (a) aqueous alkaline compositions and the (b) aqueous acidic compositions to generate carbon dioxide gas. The acid constituent may be a single acid, or may be a combination of two or more acids. The acid constituent may be an inorganic acid, an organic acid or may be a mixture of inorganic with organic acids. Exemplary useful acids include sulfuric acid, hydrochloric acid, phosphoric acid, nitric acid, boric acid, formic acid, acetic acid, lactic acid, malic acid, maleic acid, succinic acid, tartaric acid, lactic acid, glutaric acid, glycolic acid, fumaric acid, benzoic acid, citric acid, sulfamic acid, oxalic acid, and mixtures thereof. Preferably, the acid constituent is selected from hydrochloric acid, citric acid, acetic acid, lactic acid, and sulfamic acid. Especially preferably the acid constituent is a single acid selected from hydrochloric acid, citric acid, acetic acid, lactic acid, and sulfamic acid. The acid constituent should be present in sufficient amounts such that when the (a) aqueous alkaline compositions and the (b) aqueous acidic compositions are mixed, the effective release of carbon dioxide gas occurs. Where the resultant foamed hard surface treatment composition formed by mixing the (a) aqueous alkaline compositions with the (b) aqueous acidic compositions is desired to be acidic, the acid constituent should be present in sufficient amounts in order to ensure effective release of carbon dioxide gas as well as adjustment of the foamed hard surface treatment composition to an acidic pH, preferably a pH of 3 or less, more preferably a pH of 2.5 or less. Highly acidic resultant foamed hard surface treatment compositions also exhibit a good antimicrobial effect and are amongst the preferred embodiments of the invention. Additionally the acid constituent is also present in sufficient amounts such that the pH of the (b) aqueous acidic compositions remains acidic prior to mixing, preferably maintained at a pH of 6 or less, preferably at 4 or less but most preferably at a pH of 3 or less. Advantageously the acid constituent forms 0.1-15% wt., preferably 1-12% wt., more preferably 2-10% wt. of the (b) aqueous acidic compositions of the inventive compositions.

The (b) aqueous acidic compositions may include a chlorine control constituent. During the mixing of the (a) aqueous alkaline compositions and the (b) aqueous acidic compositions to form the hard surface treatment composition, the acid in the (b) aqueous acidic compositions when intermixed with the (a) aqueous alkaline composition may cause a side reaction causing the undesirable formation of chlorine gas. An exemplary reaction which may occur during such mixing may be represented as:

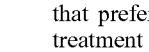

$$NaOCl+H^{+}\rightarrow HOCl\rightarrow Cl_2$$

However, generation of chlorine gas is desirably minimized or eliminated. The present inventors have surprisingly found that preferred embodiments of their two-part hard surface treatment composition formed by mixing of the (a) aqueous alkaline compositions and the (b) aqueous acidic compositions result in the generation of very small quantities of detectable chlorine gas, especially at low pHs while at the same time providing a strong foam which is attractive from a consumer standpoint and durable. Foam reducing agents or foam inhibiting agents are most desirably absent from the present inventive compositions. These results are surprising, and have been achieved both with and without the inclusion of a chlorine control constituent as part of the two-part hard surface treatment compositions taught herein. The present inventors have noted that in addition to the careful control over the amounts of constituents present in the (a) aqueous alkaline compositions and the (b) aqueous acidic compositions that the inclusion of effective amounts of one or more compounds which are effective in reacting with the chlorine gas minimizes or eliminates the amount of chlorine gas which is ultimately liberated from the foam hard surface treatment composition and enters the ambient atmosphere. While it is contemplated that any known art composition or compound which provides such an effect may be used, advantageously the chlorine control constituent is one or more materials selected from $NH_2$ containing compounds, $NH_3$ containing compounds, tetraammonium salts of citrates, tetraammonium salts of sulfates, as well as aminomethane constituents particularly tris-(hydroxymethyl)aminomethane which is particularly preferred. When included, the chlorine control constituent may be included in either the (a) aqueous alkaline compositions or the (b) aqueous acidic compositions and the chlorine control constituent may be present in any effective amount. When present, the chlorine control constituent is advantageously present in amounts of from about 0.001% wt. to about 1.5% wt., preferably 0.05-1% wt., and most desirably 0.1-0.5% wt. based on the total weight of either the (a) aqueous alkaline compositions or the (b) aqueous acidic compositions of which it forms a part. Desirably, when present, the chlorine control constituent is necessarily present in the inventive compositions and is desirably present solely in the (b) aqueous acidic compositions.

In certain preferred embodiments of the invention the inventors have surprisingly observed that the use of sulfamic acid in the (b) aqueous acidic compositions may provide the dual benefit of adjusting the pH of the (b) aqueous acidic compositions to a preferred pH range, but also function in part as a chlorine control constituent. While not wishing to be bound by the following it is hypothesized that the —$NH_2$ group present in sulfamic acid may combine with free chlorine ions ($Cl^-$) which may be liberated during or following the mixing of the (a) aqueous alkaline compositions with the (b) aqueous acidic compositions, and thus diminish the presence of chlorine gas in an ambient environment. Thus it is believed that any organic or inorganic acid compound comprising the —$NH_2$ group may also provide the same dual benefits outlined above.

In certain preferred embodiments the inventors have also found that two-part hard surface treatment compositions which formed by mixing the (a) aqueous alkaline compositions or the (b) aqueous acidic compositions as taught herein which produce minimal amount of chlorine gas may also be produced, even in the absence of a chlorine control constituent. While not wishing to be bound by the following it is believed that such compositions are attained by providing the stochiometrically equivalent amounts of the bleach constituent in the (a) aqueous alkaline compositions and of the hydrogen peroxide in the (b) aqueous acidic compositions such that side reactions resulting in the formation of undesired chlorine gas can be avoided.

In particularly preferred embodiments, the two-part hard surface treatment composition taught herein generates a minimal amount of free chlorine gas when formed, namely 1 ppm or less, preferably not more than 0.5 ppm, more preferably not more than about 0.15 ppm, still more preferably not more than about 0.10 ppm, and especially preferably not more than about 0.05 parts per million when measured during a 15 to 30, preferably during a 15 minute time interval within the first 60 minutes following mixing of the (a) aqueous alkaline composition with the (b) aqueous acidic compositions thereby forming the two-part hard surface treatment composition taught herein.

Alternately in certain of the preferred embodiments there is provided a two-part hard surface treatment composition characterized in that the foamed hard surface treatment composition generates not more than 1 parts per million, preferably not more than about 0.15 parts per million, more preferably not more than about 0.10 parts per million, yet more preferably not more than about 0.5 parts per million when measured when measured during a 15 to 30 minute time interval within the last 60 minutes of the first 60 minute interval following mixing of the (a) aqueous alkaline composition with the (b) aqueous acidic compositions.

In certain of these particularly preferred embodiments a chlorine control constituent is necessarily present, while in other particularly preferred embodiments a chlorine control constituent is necessarily absent. These chlorine gas levels may be evaluated according to conventional analytical techniques described hereinafter with reference to the Examples, which is a preferred protocol for the evaluation of the free $Cl_2$ gas formed.

As both the (a) aqueous alkaline compositions and the (b) aqueous acidic compositions are largely aqueous in nature; water is added to order to provide to 100% by weight of each of these respective compositions. The water may be tap water, but is preferably distilled and is most preferably deionized water. If the water is tap water, it is preferably substantially free of any undesirable impurities such as organics or inorganics, especially mineral salts which are present in hard water which may thus undesirably interfere with the operation of the constituents present in either the (a) aqueous alkaline compositions or the (b) aqueous acidic compositions according to the invention.

The compositions of the present invention may also optionally comprise one or more further constituents which are directed to improving the aesthetic or functional features of the inventive compositions. Such constituents may be present in either the (a) aqueous alkaline compositions or the (b) aqueous acidic compositions, and should be selected so to be compatible with the remaining constituents present in the compositions of which they form a part. By way of non-limiting example such further constituents include one or more fragrances and fragrance solubilizers, coloring agents such as dyes or pigments, viscosity modifying agents, other surfactants, and preservatives. When one or more of the optional constituents is added, i.e., fragrance agents, the esthetic and consumer appeal of the product is often favorably improved. The use and selection of these optional constituents, as well as the compatibility of one or more optional constituents with the balance of the constituents of the first composition or second composition need be considered prior to inclusion in the present inventive compositions. Generally however, when included, the one or more optional constituents present in the inventive compositions do not exceed about 10% wt., preferably do not exceed 5% wt. based on the total weight of the first composition or second composition of which they form a part.

One or more coloring agents, such as dyes or pigments may be included in either the (a) aqueous alkaline compositions or the (b) aqueous acidic compositions or both. The dyes suitable for use in the present invention are those generally known to those of skill in the art. Examples of such dyes include copper phthalocyanine tetrasulfonic acid tetra sodium salt, all derivatized and underivatized phthalocyanines such as Pigment Green 7, Pigment Blue 15, and Pigment Blue 86, inorganic pigments, such as lazurite, and combinations thereof. However it is to be understood that essentially any water soluble or water dispersible dye or other coloring agent may be used as long as it is stable at the pH of the (a) aqueous alkaline composition or the (b) aqueous acidic compositions of which it forms a part. When present, the coloring agents may be included in any effective amount. Desirably the coloring agents comprise not more than 2% wt, preferably not more than 1% wt. of the (a) aqueous alkaline composition or the (b) aqueous acidic compositions of which it forms a part Fragrances are optionally but desirably included in the inventive compositions and may be present in either (a) aqueous alkaline compositions or the (b) aqueous acidic compositions in any effective amount. However it is preferred that when a fragrance is present, that it be comprised only within the (a) aqueous alkaline compositions. The term "fragrance" is used to refer to and to include any non-water soluble fragrance substance or mixture of such substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally perfumes are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance composition. Examples of such fragrances include digeranyl succinate, dineryl succinate, geranyl neryl succinate, geranyl phenylacetate, neryl phenylacetate, geranyl laurate, neryl laurate, di(b-citronellyl)maleate, dinonadol maleate, diphenoxyanol maleate, di(3,7-dimethyl-1-octanyl) succinate, di(cyclohexylethyl)maleate, diflralyl succinate, di(phenylethyl)adipate, 7-acetyl-1,2,3,4,5,6,7,8-octahydro-1,1,6,7-tetramethyl naphthalene, ionone methyl, ionone gamma methyl, methyl cedrylone, methyl dihydrojasmonate, methyl 1,6,10-trimethyl-2,5,9-cyclododecatrien-1-yl ketone, 7-acetyl-1,1,3,4,4,6-hexamethyl tetralin, 4-acetyl-6-tert-butyl-1-, 1-dimethyl indane, para-hydroxy-phenyl-butanone, benzophenone, methyl beta-naphthyl ketone, 6-acetyl-1,1,2,3,3,5hexamethyl indane, 5-acetyl-3-isopropyl-1,1,2,6-tetramethyl indane, 1-dodecanal, 4-(4-hydroxy-4-methylpentyl)-3-cyclohexene-1-carboxaldehyde, 7-hydroxy-3,7-dimethyl ocatanal, 10-undecen-1-al, isohexenyl cyclohexyl carboxaldehyde, formyl tricyclodecane, condensation products of hydroxycitronellal and methyl anthranilate, condensation products of hydroxycitronellal and indol, condensation products of phenyl acetaldehyde and indol, 2-methyl-3-(para-tert-butylphenyl)-propionaldehyd-e, ethyl vanillin, heliotropin, hexyl cinnamic aldehyde, amyl cinnamic aldehyde, 2-methyl-2-(para-iso-propylphenyl)propionaldehyde, coumarin, decalactone gamma, cyclopentadecanolide, 16-hydroxy-9-hexadecenoic acid lactone, 1,3,4,6,7,8-hexahydro-4,6,6,7,8,8-hexamethylcyclopenta-gamma-2-b-enzopyrane, beta-naphthol methyl ether, ambroxane, dodecahydro-3a,6,6,9a-t-etramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-bute-n-1-ol, caryophyllene alcohol, tricyclodecenyl propionate, tricyclodecenyl acetate, benzyl salicylate, cedryl acetate, para-(tert-butyl)cyclohexyl acetate, essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin, and lavender, phenyl ethyl alcohol, terpineol, linalool, linalyl acetate, geraniol, nerol, 2-(1,1-dimethylethyl)cyclohexanol acetate, benzyl acetate, orange terpenes, eugenol, diethylphthalate, and combinations thereof. In the present invention, the precise composition of the fragrance is of no particular consequence so long as it may be effectively included as a constituent of the compositions, and have a pleasing fragrance.

When present, the fragrance comprises up to 5% by weight of the (a) aqueous alkaline composition or the (b) aqueous acidic composition of which it forms a part.

Optionally but often advantageously either the (b) aqueous acidic composition additionally includes a peroxide stabilizer which is particularly useful in improving the high temperature stability of the peroxide constituent, particularly hydrogen peroxide. Known art peroxide stabilizer, particularly 1-hydroxy-1,1-ethylidene diphosphonate commercially available as DEQUEST 2010 or a similar phosphonate compound. By way of non-limiting example further peroxide stabilizers include: amino tri(methylene-phosphonic acid) available as DEQUEST 2000 and DEQUEST 2000LC; amino tri (methylene-phosphonic acid)pentasodium salt available as DEQUEST 2006; 1-hydroxyethylene-1,1,-diphosphonic acid commercially available as DEQUEST 2010; 1-hydroxyethylene-1,1,-diphosphonic acid tetrasodium salt available as DEQUEST 2016 and DEQUEST 2016D; ethylene diamine tetra(methylene phosphonic acid) available as DEQUEST 2041; ethylene diamine tetra(methylene phosphonic acid)pentasodium salt available as DEQUEST 2046; hexamethylenediamine tetra(methylene phosphonic acid) potassium salt available as DEQUEST 2054; diethylenetriamine penta(methylene phosphonic acid) available as DEQUEST 2060S; diethylenetriamine penta (methylenephosphonic acid)trisodium salt available as DEQUEST 2066A; diethylenetriamine penta(methylene-phosphonic acid)pentasodium salt available as DEQUEST 2066; diethylenetriamine penta(methylene phosphonic acid) pentasodium salt commercially available as DEQUEST 2066C2; 2-phosphonobutane-1,2,4-tricarboxylic acid commercially available as DEQUEST 7000, tetrasodium salt of 1-hydroxy ethyliden (1,1-diphosphonic acid) commercially available as DEQUEST SPE 9528, as well as other materials sold under the DEQUEST tradename, particularly DEQUEST 2086, DEQUEST 3000S, as well as DEQUEST 6004. Other known art compositions or compounds which provide a similar peroxide stabilizing effect may also be used, including, inter alia, tris(hydroxymethyl)aminomethane. When present, the peroxide stabilizer may be included in any effective amount. Desirably the peroxide stabilizer is necessarily present in the (b) aqueous acidic composition. When present, the peroxide stabilizer comprises 0.01-2% wt, preferably 0.05-1% wt., and most preferably 0.1-0.5% wt. of the (b) aqueous acidic composition of which it forms a part.

While optional, the inclusion of a viscosity modifying agent is contemplated as being useful wherein a thicker or more viscous hard surface treatment composition is desired.

Exemplary useful viscosity modifying agents include polysaccharide polymers e.g., cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

Specific examples of the cellulose derivatives include methyl cellulose ethyl cellulose, hydroxymethyl cellulose hydroxy ethyl cellulose, hydroxy propyl cellulose, carboxy methyl cellulose, carboxy methyl hydroxyethyl cellulose, hydroxypropyl cellulose, hydroxy propyl methyl cellulose, ethylhydroxymethyl cellulose and ethyl hydroxy ethyl cellulose.

Specific examples of polycarboxylate polymers thickeners have a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups.

Further exemplary useful viscosity modifying agents include clays for example, colloid-forming clays, such as smectite and/or attapulgite types. The clay materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites). Various commercially available clays e.g., montmorillonite, bentonite, volchonskoite, nontronite, beidellite, hectorite, saponite, sauconite and vermiculite may also be used.

When present, the viscosity modifying agent is present in a sufficient amount such that a desired viscosity of the final foamed hard surface treatment composition is attained. When present, the amount of the one or more viscosity modifying agents comprises up to 5% by weight of the composition of which it forms a part.

Optionally, one or more of the (a) aqueous alkaline compositions or the (b) aqueous acidic compositions may include one or more further detersive surfactants as noted above. When included in either of the (a) aqueous alkaline compositions or the (b) aqueous acidic compositions they should be selected such that they remain stable at the respective pH of the (a) aqueous alkaline compositions or the (b) aqueous acidic compositions.

A further optional constituent is a preservative constituent. Useful preservatives suitable for use in the present invention are those generally known to those of skill in the art. Examples of such preservatives include formalin, 5-bromo-5-nitro-dioxan-1,3,5-chloro-2-methyl-4-isothaliazolin-3-one, 2,6-di-tert.butyl-p-cresol, parabens including methyl parabens and ethyl parabens, glutaraldehyde, formaldehyde, 5-chloro-2-methyl-4-isothiazolin3-one, 2-methyl-4-isothiazoline-3-one, a mixture of 5-chloro-2-methyl-4-isothiazolin-3-one and 2-methyl-4-isothiazolin-3-one marketed under the trademark KATHON CG/ICP as well as combinations thereof. These preservatives may be provided in effective amounts to achieve the desired preservative effect. When present, the preservative constituent is present in any effective amount; and generally when present comprises up to 5% by weight of the composition of which it forms a part.

Most desirably the inventive compositions do not include a foam inhibiting compound or composition, such as a silicone based defoamer which would defeat or unduly diminish foaming during or after mixture of the (a) aqueous alkaline compositions with the (b) aqueous acidic compositions.

The constituents useful in the (a) aqueous alkaline compositions and the (b) aqueous acidic compositions are individually, per se, known to the art, and include those described in *McCutcheon's Emulsifiers and Detergents* (Vol. 1), *McCutcheon's Functional Materials* (Vol. 2), North American Edition, 1991; *Kirk-Othmer, Encyclopedia of Chemical Technology,* 3rd Ed., Vol. 22, the contents of which are herein incorporated by reference For any particular composition, such optional ingredients should be compatible with the other ingredients present.

According to a further preferred embodiment, the resultant foamed hard surface treatment composition formed by the admixture of two aqueous compositions described herein has a pH of less than about 4, preferably about 3 or less, and most preferably has a pH of about 2.5 or less. Such preferred embodiments provide foamed hard surface cleaning compositions which are particularly useful in the removal of limescale and soap scum such as are frequently encountered on hard surfaces, particularly lavatory surfaces as well as kitchen surfaces.

According to a different preferred embodiment, the resultant foamed hard surface treatment composition formed by the admixture of two aqueous compositions described herein has an alkaline pH of about 9 or greater, preferably about 10 or greater, and most preferably of about 11 or greater. Such preferred embodiments provide foamed hard surface cleaning compositions which are useful in the removal of hard water stains, soap scum, such as are frequently encountered on lavatory surfaces which however are sensitive to acidic cleaning compositions, including so called "European porcelain" or "European enamel" hard surfaces. Such surfaces are known to be particularly sensitive to acidic compositions, especially acidic compositions characterized in having a low pH (less than pH=4). Thus, the use of acidic compositions are typically not compatible with such "European porcelain" or "European enamel" hard surfaces. Thus the inventive compositions provide a useful alternative which is effective and safe on such surfaces. Such foamed alkaline hard surface treatment composition are also useful in the removal of greasy soils from hard surfaces, such kitchen surfaces, flooring surfaces, tile surfaces and the like.

Particularly preferred embodiments of the inventive compositions exhibit good storage stability.

According to certain particularly preferred embodiments of the invention, the resultant a two-part hard surface treatment composition which is formed by the admixture of two aqueous compositions also provides in addition to a useful cleaning benefit, a sanitizing or disinfecting benefit as well. Such particularly preferred embodiments demonstrate antimicrobial efficacy against one or more microorganisms selected from: *S. aureus, E. coli, Ps. aeruginosa*, and *E. hirae.*

According to one particularly preferred embodiment there is provided a foamed acidic hard surface treatment composition which is formed by the admixture of:

(a) an aqueous alkaline composition comprising:
a bleach constituent;
an alkaline constituent;
optionally but desirably a gas releasing constituent;
a nonionic surfactant, preferably an amine oxide;
and,
(b) an aqueous acidic composition comprising:
a peroxide constituent,
an acid constituent;
optionally, but desirably a chlorine control constituent;
optionally, but desirably a peroxide stabilizer;

which (a) and (b) compositions are kept separate, but which are admixed immediately prior to use or upon use to form the foamed hard surface treatment composition, characterized in that the foamed hard surface treatment composition exhibits a cleaning benefit and a disinfecting or sanitizing benefit, and is at an acidic pH, preferably a pH of about 4 or less, more preferably a pH of about 3 or less, especially a pH of about 2.5 or less and further characterized in that the foamed hard surface treatment composition forms a minimal amount of chlorine gas when formed.

According to a further particularly preferred embodiment there is provided foamed hard surface treatment composition which is formed by the admixture of:

(a) an aqueous alkaline composition comprising:
a bleach constituent;
an alkaline constituent;
optionally but desirably a gas releasing constituent;
a nonionic surfactant, preferably an amine oxide;
and,
(b) an aqueous acidic composition comprising:
a peroxide constituent;
an acid constituent;
optionally, but desirably a chlorine control constituent;
optionally, but desirably a peroxide stabilizer;

which (a) and (b) compositions are kept separate, but which are admixed immediately prior to use or upon use to form a foamed hard surface treatment composition, characterized in that the foamed hard surface treatment composition exhibits a cleaning benefit and/or a disinfecting or sanitizing benefit, and is at an alkaline pH preferably a pH of about 9 or greater, preferably about 10 or greater, further characterized in that the foamed hard surface treatment composition forms a minimal amount of chlorine gas when formed.

According to a further particularly preferred embodiment there is provided a foamed hard surface treatment composition which is formed by the admixture of:

(a) an aqueous alkaline composition comprising:
a bleach constituent;
an alkaline constituent;
optionally but desirably a gas releasing constituent;
a nonionic surfactant, preferably an amine oxide;
and,
(b) an aqueous acidic composition comprising:
a peroxide constituent,
an acid constituent;
optionally, but desirably a chlorine control constituent;
optionally, but desirably a peroxide stabilizer;

which compositions are kept separate, but which are admixed immediately prior to use or upon use to form a foamed hard surface treatment composition, characterized in that the foamed hard surface treatment composition exhibits a cleaning benefit and a disinfecting or sanitizing benefit, and generates a minimal amount of chlorine gas when formed, preferably not more than about 0.5, preferably not more than about 0.15, yet more preferably not more than about 0.5 parts per million when measured at a 15-30 minute time interval within the first 60 minutes following mixing of the (a) aqueous alkaline composition with the (b) aqueous acidic composition.

Preferred compositions according to the invention form a stable foam which has a generally homogenous distribution of cells within the foam body, indicative of uniform gas formation when the (a) aqueous alkaline compositions and the (b) aqueous acidic compositions are intermixed.

The (a) aqueous alkaline compositions and (b) aqueous acidic compositions of the foamed hard surface cleaning compositions according to the invention are easily produced by any of a number of known art techniques. Conveniently, for said compositions, a part of the water is supplied to a suitable mixing vessel further provided with a stirrer or agitator, and while stirring, the remaining constituents are added to the mixing vessel, including any final amount of water needed to provide to 100% wt. of the first components and second components of the inventive compositions described herein.

The foamed hard surface cleaning compositions of the invention may be stored prior to use and in any of a variety of known art containers, it being required only that (a) aqueous alkaline compositions and the (b) aqueous acidic compositions remain isolated from one another during storage until shortly prior to, or upon use in the treatment of hard surfaces. Preferably each of (a) aqueous alkaline compositions and the (b) aqueous acidic compositions are separately stored from and dispensed from separate containers in two-compartment dispenser which is adapted to dispense each of said compositions onto a surface, either sequentially or, preferably, simultaneously. For example, exemplary two-compartment dispensers include those disclosed in U.S. Pat. Nos. 3,760,986; 5,152,461; 5,332,157; 5,439,141; 5,560,545;5,562,250; 5,626,259; 5,887,761; 5,964,377; 5,472,119; 5,385,270; 5,009,342; 4,902,281; 4,826,048; 5,339,990; 4,949,874, 5,562,250; 4,355,739; 3,786,963; 5,934,515; 3,729,553; 5,154,917; 5,289,950; 5,252,312; CA2306283; EP875460; EP979782; EP479451; and WO9505327, the contents of which are herein incorporated by reference thereto.

The inventive compositions are desirably provided as a ready-to-use product which may be directly applied to a hard surface. By way of example, hard surfaces suitable for coating with the polymer include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone. Still further hard surfaces include those associated with medical facilities, e.g., hospitals, clinics as well as laboratories, e.g., medical testing laboratories.

The following examples below illustrate exemplary formulations and certain particularly preferred formulations of the inventive composition. It is to be understood that these examples are presented by means of illustration only and that further useful formulations fall within the scope of this invention and the claims may be readily produced by one skilled in the art and not deviate from the scope and spirit of the invention. Throughout this specification and in the accompanying claims, weight percents of any constituent are to be understood as the weight percent of the active portion of the referenced constituent, unless otherwise indicated.

EXAMPLES

Examples of inventive formulations are shown in the following table; unless otherwise stated, the components indicated are provided as "100% active" unless otherwise stated on Table 1 or Table 2. The amounts of the named constituents are indicated in % w/w based on a total weight of either the respective individual (a) aqueous alkaline compositions or the (b) aqueous acidic compositions. Deionized water was added in "quantum sufficient" ("q.s.") to each of (a) aqueous alkaline compositions and the (b) aqueous acidic compositions so to provide the balance to 100 parts by weight of each.

The compositions of the (a) aqueous alkaline compositions and the (b) aqueous acidic compositions as indicated on the following Table 1 were separately produced by providing measured amounts of the individual constituent to a proportion of the water present in each individual component under stirring and at room temperature. The (a) aqueous alkaline compositions and the (b) aqueous acidic compositions were produced separately.

TABLE 1

| | Example: | | | | | | | | | |
|---|---|---|---|---|---|---|---|---|---|---|
| | Ex. 1 | | Ex. 2 | | Ex. 3 | | Ex. 4 | | Ex. 5 | |
| | (a)[1] | (b)[2] | (a) | (b) | (a) | (b) | (a) | (b) | (a) | (b) |
| NaOCl | 1.31 | — | 5.17 | — | 3.51 | — | 2.59 | — | 1.63 | — |
| NaOH (50% wt.) | 3.0 | — | 5.0 | — | 3.5 | — | 1.5 | — | 2.0 | — |
| $Na_2CO_3$ | 3.0 | — | 3.0 | — | 1.0 | — | 2.0 | — | 2.5 | — |
| $NaHCO_3$ | 2.0 | — | 2.0 | — | 0.3 | — | — | — | — | — |
| AMMONYX LO (30% wt.) | 5.0 | — | 5.0 | — | 5.0 | — | 5.0 | — | 5.0 | — |
| Fragrance | 0.08 | — | 0.2 | — | 0.2 | — | — | — | 0.08 | — |
| $H_2O_2$ (35% wt.) | — | 6.86 | — | 10.0 | — | 10.0 | — | 10.0 | — | 8.0 |
| HCl (37.7% wt.) | — | 12.60 | — | — | — | — | — | — | — | — |
| Acetic acid (80%) | — | — | — | 2.5 | — | 0.5 | — | 9.0 | — | 2.37 |
| Sulfamic acid | — | — | — | — | — | — | — | 6.0 | — | — |
| Tris-Amino $Cl_2$ | — | — | — | 1.50 | — | — | — | 1.5 | — | — |
| Deionized water | q.s. | q.s. | q.s. | q.s. | q.s. | q.s. | q.s. | q.s. | q.s. | q.s. |
| pH of (a) | 12.74 | — | 13.08 | — | 13.19 | — | 12.84 | — | 13.06 | — |
| pH of (b) | — | <1 | — | 4.01 | — | 2.88 | — | <1 | — | 2.59 |
| pH of mixture (a) + (b) | 3.91 | | 10.03 | | 11.38 | | 3.77 | | 9.40 | |
| $Cl_2$ gas measured(ppm) following mixture of (a) + (b) at time after mixing | | | | | | | | | | |
| 15 minutes | **[3] | | ** | | ** | | 0.06 | | 0.08 | |
| 18 minutes | 0.10 | | 0.09 | | 0.11 | | ** | | ** | |
| 30 minutes | ** | | ** | | ** | | 0.06 | | 0.08 | |
| 36 minutes | 0.20 | | 0.09 | | 0.08 | | ** | | ** | |
| 45 minutes | ** | | ** | | ** | | ** | | 0.14 | |
| 54 minutes | 2.30 | | ** | | ** | | ** | | ** | |
| 60 minutes | ** | | ** | | ** | | ** | | 0.14 | |
| 90 minutes | 4.30 | | ** | | ** | | ** | | ** | |
| 120 minutes | 1.92 | | ** | | ** | | ** | | ** | |

| | Example: | | | | | | | | | |
|---|---|---|---|---|---|---|---|---|---|---|
| | Ex. 6 | | Ex. 7 | | Ex. 8 | | Ex. 9 | | Ex. 10 | |
| | (a) | (b) | (a) | (b) | (a) | (b) | (a) | (b) | (a) | (b) |
| NaOCl | 2.07 | — | 3.59 | — | 2.60 | — | 2.60 | — | 2.60 | — |
| NaOH (50% wt.) | 2.0 | — | 2.0 | — | 2.0 | — | 2.0 | — | 1.5 | — |
| $Na_2CO_3$ | 2.5 | — | 2.5 | — | 2.5 | — | 2.5 | — | 2.0 | — |
| AMMONYX LO (30% wt.) | 5.0 | — | 5.0 | — | 5.0 | — | 5.0 | — | 4.0 | — |
| Fragrance | 0.1 | — | 0.1 | — | 0.1 | — | 0.1 | — | 0.08 | — |
| $H_2O_2$ (35% wt.) | — | 5.0 | — | 8.0 | — | 8.0 | — | 8.0 | — | 8.0 |
| HCl (37.7% wt.) | — | — | — | — | — | — | — | — | — | — |
| Acetic acid (80%) | — | 8.0 | — | — | — | — | — | — | — | — |
| Sulfamic acid | — | 8.8 | — | 8.05 | — | 7.39 | — | 7.39 | — | 6.45 |
| Tris-Amino $Cl_2$ | — | — | — | — | — | — | — | — | — | — |
| Amp 95 | — | — | — | — | — | — | — | 0.05 | — | — |
| Deionized water | q.s. | q.s. | q.s. | q.s. | q.s. | q.s. | q.s. | q.s. | q.s. | q.s. |
| pH of (a) | 13.09 | — | 13.10 | — | 12.96 | — | 13 | — | 12.94 | — |
| pH of (b) | — | <1 | — | <1 | — | <1 | — | <1 | — | <1 |
| pH of mixture (a) + (b) | 2.24 | | 2.28 | | 2.31 | | 2.26 | | 1.92 | |

TABLE 1-continued

| $Cl_2$ gas measured(ppm) following mixture of (a) + (b) at time after mixing | | | | | |
|---|---|---|---|---|---|
| 15 minutes | <0.05 | <0.05 | 0.06 | 0.097 | ** |
| 18 minutes | ** | ** | ** | ** | ** |
| 30 minutes | <0.05 | <0.05 | 0.06 | 0.097 | ** |
| 36 minutes | ** | ** | ** | ** | ** |
| 45 minutes | ** | <0.05 | <0.05 | ** | 0.098 |
| 54 minutes | ** | ** | ** | ** | ** |
| 60 minutes | ** | <0.05 | <0.05 | ** | 0.098 |

| | Example: | | | | | | | |
|---|---|---|---|---|---|---|---|---|
| | Ex. 11 | | Ex. 12 | | Ex. 13 | | Ex. 14 | |
| | (a) | (b) | (a) | (b) | (a) | (b) | (a) | (b) |
| NaOCl | 1.49 | — | 2.60 | — | 2.60 | — | 2.60 | — |
| NaOH (50% wt.) | 2.0 | — | 1.5 | — | 1.5 | — | 1.5 | — |
| $Na_2CO_3$ | 2.5 | — | 2.0 | — | 2.0 | — | 2.0 | — |
| AMMONYX LO (30% wt.) | 5.0 | — | 4.0 | — | 4.0 | — | 4.0 | — |
| Fragrance | 0.1 | — | 0.08 | — | 0.05 | — | 0.05 | — |
| $H_2O_2$ (35% wt.) | — | 5.0 | — | 8.0 | — | 8.0 | — | 8.0 |
| HCl (37.7% wt.) | — | — | — | — | — | — | — | — |
| Acetic acid (80%) | — | — | — | — | — | 1.5 | — | 1.5 |
| Sulfamic acid | — | 8.55 | — | 6.55 | — | 6.75 | — | 6.8 |
| Tris-Amino $Cl_2$ control | — | — | — | 0.05 | — | — | — | 0.05 |
| Deionized water | q.s. | q.s. | q.s. | q.s. | q.s. | q.s. | q.s. | q.s. |
| pH of (a) | 13.09 | — | 12.94 | — | 12.95 | — | 12.95 | — |
| pH of (b) | — | <1 | — | <1 | — | <1 | — | <1 |
| pH of mixture (a) + (b) | 2.24 | | 1.72 | | 1.86 | | 1.99 | |
| $Cl_2$ gas measured(ppm) following mixture of (a) + (b) at time after mixing | | | | | | | | |
| 15 minutes | <0.05 | | <0.05 | | <0.05 | | <0.05 | |
| 18 minutes | ** | | ** | | ** | | ** | |
| 30 minutes | <0.05 | | <0.05 | | <0.05 | | <0.05 | |
| 36 minutes | ** | | ** | | ** | | ** | |
| 45 minutes | <0.05 | | <0.05 | | <0.05 | | ** | |
| 54 minutes | ** | | ** | | ** | | ** | |
| 60 minutes | <0.05 | | <0.05 | | <0.05 | | ** | |

| | Example: | | | | | |
|---|---|---|---|---|---|---|
| | Ex. 15 | | Ex. 16 | | Ex. 17 | |
| | (a) | (b) | (a) | (b) | (a) | (b) |
| NaOCl | 2.60 | — | 2.60 | — | 2.60 | — |
| NaOH (50% wt.) | 2.0 | — | 2.0 | — | 2.0 | — |
| $Na_2CO_3$ | 2.5 | — | 2.0 | — | 2.0 | — |
| AMMONYX LO (30% wt.) | 5.0 | — | 3.0 | — | 5.0 | — |
| Fragrance | 0.1 | — | 0.1 | — | 0.1 | — |
| $H_2O_2$ (35% wt.) | — | 8.0 | — | 7.15 | — | 8.0 |
| HCl (37.7% wt.) | — | — | — | — | — | — |
| Acetic acid (80%) | — | — | — | — | — | — |
| Sulfamic acid | — | 8.15 | — | 6.50 | — | 6.5 |
| Tris-Amino $Cl_2$ control | — | 0.20 | — | 0.10 | — | — |
| DPA | — | — | — | — | — | 0.10 |
| Deionized water | q.s. | q.s. | q.s. | q.s. | q.s. | q.s. |
| pH of (a) | 13.10 | — | 13 | — | 13 | — |
| pH of (b) | — | <1 | — | <1 | — | <1 |
| pH of mixture (a) + (b) | 2.39 | | 2.04 | | 2.5 | |
| $Cl_2$ gas measured(ppm) following mixture of (a) + (b) at time after mixing | | | | | | |
| 15 minutes | <0.05 | | ** | | ** | |
| 30 minutes | <0.05 | | <0.05 | | 0.064 | |
| 45 minutes | <0.05 | | ** | | ** | |
| 60 minutes | <0.05 | | <0.05 | | 0.066 | |
| 90 minutes | ** | | ** | | <0.05 | |
| 120 minutes | ** | | ** | | <0.05 | |
| 150 minutes | ** | | ** | | <0.05 | |
| 180 minutes | ** | | ** | | <0.05 | |

TABLE 1-continued

| | | | |
|---|---|---|---|
| 210 minutes | ** | ** | <0.05 |
| 240 minutes | ** | ** | <0.05 |

| | Example: | | | | | |
|---|---|---|---|---|---|---|
| | Ex. 18 | | Ex. 19 | | Ex. 20 | |
| | (a) | (b) | (a) | (b) | (a) | (b) |
| NaOCl | 2.58 | — | 2.58 | — | 2.58 | — |
| NaOH (50% wt.) | 2.0 | — | 2.0 | — | 2.0 | — |
| $Na_2CO_3$ | 1.65 | — | 1.8 | — | 1.82 | — |
| AMMONYX LO (30% wt.) | 3.0 | — | 3.0 | — | 3.0 | — |
| Fragrance | 0.15 | — | 0.15 | — | 0.15 | — |
| $H_2O_2$ (50% wt.) | — | 5.25 | — | 5.25 | — | 5.25 |
| HCl (37.7% wt.) | — | — | — | — | — | — |
| Acetic acid (80%) | — | — | — | — | — | — |
| Sulfamic acid | — | 6.0 | — | 6.0 | — | 6.0 |
| Tris-Amino $Cl_2$ control | — | 0.10 | — | 0.10 | — | 0.10 |
| DPA | — | — | — | — | — | — |
| Deionized water | q.s. | q.s. | q.s. | q.s. | q.s. | q.s. |
| pH of (a) | **[4] | ** | ** | ** | ** | ** |
| pH of (b) | ** | ** | ** | ** | ** | ** |
| pH of mixture (a) + (b) | 2.1-2.4 | | 2.6 | | 4.45 | |

| | Example: | | | | | |
|---|---|---|---|---|---|---|
| | Ex. 21 | | Ex. 22 | | Ex. 23 | |
| | (a) | (b) | (a) | (b) | (a) | (b) |
| NaOCl | 2.6 | — | 2.67 | — | 2.85 | — |
| NaOH (50% wt.) | 2.0 | — | 2.0 | — | 2.0 | — |
| $Na_2CO_3$ | 1.48 | — | 1.40 | — | 1.38 | — |
| AMMONYX LO (30% wt.) | 3.0 | — | 3.0 | — | 3.0 | — |
| Fragrance | 0.15 | — | 0.15 | — | 0.15 | — |
| $H_2O_2$ (50% wt.) | — | 5.25 | — | 5.25 | — | 5.25 |
| HCl (37.7% wt.) | — | — | — | — | — | — |
| Acetic acid (80%) | — | — | — | — | — | — |
| Sulfamic acid | — | 5.5 | — | 5.5 | — | 5.5 |
| Tris-Amino $Cl_2$ control | — | 0.10 | — | 0.10 | — | 0.10 |
| DPA | — | — | — | — | — | — |
| Deionized water | q.s. | q.s. | q.s. | q.s. | q.s. | q.s. |
| pH of (a) | 13 | — | ** | ** | ** | ** |
| pH of (b) | — | <1 | ** | ** | ** | ** |
| pH of mixture (a) + (b) | 2.8 | | 2.5 | | 2.55 | |

| | Example: | | | | | |
|---|---|---|---|---|---|---|
| | Ex. 24 | | Ex. 25 | | Ex. 26 | |
| | (a) | (b) | (a) | (b) | (a) | (b) |
| NaOCl | 2.97 | — | 3.06 | — | 2.99 | — |
| NaOH (50% wt.) | 2.0 | — | 2.0 | — | 2.0 | — |
| $Na_2CO_3$ | 1.35 | — | 1.32 | — | 1.38 | — |
| AMMONYX LO (30% wt.) | 3.0 | — | 3.0 | — | 3.0 | — |
| Fragrance | 0.15 | — | 0.15 | — | 0.15 | — |
| $H_2O_2$ (50% wt.) | — | 5.25 | — | 5.25 | — | 5.25 |
| HCl (37.7% wt.) | — | — | — | — | — | — |
| Acetic acid (80%) | — | — | — | — | — | — |
| Sulfamic acid | — | 5.5 | — | 5.5 | — | 5.5 |
| Tris-Amino $Cl_2$ control | — | 0.10 | — | 0.10 | — | 0.15 |
| DPA | — | — | — | — | — | — |
| Deionized water | q.s. | q.s. | q.s. | q.s. | q.s. | q.s. |
| pH of (a) | ** | ** | ** | ** | ** | ** |
| pH of (b) | ** | ** | ** | ** | ** | ** |
| pH of mixture (a) + (b) | 2.62 | | 2.09 | | 2.74 | |

TABLE 1-continued

| | Example: | | | |
|---|---|---|---|---|
| | Ex. 27 | | Ex. 28 | |
| | (a) | (b) | (a) | (b) |
| NaOCl | 3.12 | — | 2.5 | — |
| NaOH (50% wt.) | 2.0 | — | 2.0 | — |
| $Na_2CO_3$ | 1.36 | — | 2.0 | — |
| AMMONYX LO (30% wt.) | 3.0 | — | 3.0 | — |
| Fragrance | 0.15 | — | 0.15 | — |
| $H_2O_2$ (50% wt.) | — | 5.25 | — | — |
| $H_2O_2$ (35% wt.) | — | — | — | 7.15 |
| HCl (37.7% wt.) | — | — | — | — |
| Acetic acid (80%) | — | — | — | — |
| Sulfamic acid | — | 5.5 | — | 6.0 |
| Tris-Amino $Cl_2$ control | — | 0.15 | — | 0.10 |
| DPA | — | — | — | — |
| Deionized water | q.s. | q.s. | q.s. | q.s. |
| pH of (a) | ** | ** | ** | ** |
| pH of (b) | ** | ** | ** | ** |
| pH of mixture (a) + (b) | 2.56 | | ** | |

(a)[1] aqueous alkaline composition
(b)[2] aqueous acidic composition
[3]indicates that no evaluation was performed at the indicated time interval
[4]indicates that no evaluation was performed The constituents used to produce the Example compositions described on Table 1 were produced using commercially available materials, "as supplied" by their respective manufacturer/supplier. The identity of the specific constituents, and weight percent of actives contained in each named as supplied constituent used to produce the example compositions are identified in the following Table 2.

TABLE 2

| | |
|---|---|
| NaOCl | NaOCl provided as aqueous preparation; amount shown on Table 1 represents active weight of NaOCl provided within an aqueous preparation |
| NaOH (50% wt.) | aqueous NaOH composition, 50% wt. actives) |
| NaOH (35% wt.) | aqueous NaOH composition, 35% wt. actives) |
| $Na_2CO_3$ | anhydrous $Na_2CO_3$ (100% wt. actives) |
| $NaHCO_3$ | anhydrous $NaHCO_3$ (100% wt. actives) |
| AMMONYX LO (30% wt.) | lauryl dimethyl amine oxide (30% wt. actives) |
| Fragrance | proprietary composition of its supplier |
| $H_2O_2$ (35% wt.) | aqueous hydrogen peroxide containing preparation (35% wt. actives) |
| HCl (37.7% wt.) | aqueous preparation of hydrochloric acid (37.7% wt. actives) |
| Acetic acid (80%) | aqueous preparation of acetic acid (80% wt. actives) |
| Sulfamic acid (100%) | amidosulfonic acid (100% wt. actives) |
| Tris-Amino $Cl_2$ | tris(hydroxymethyl)aminomethane, (100% wt. actives) ex. Angus Chemical Co. (Buffalo Grove, IL) |
| Amp 95 | 2-amino-2-methyl-1-propanol (95% wt. actives) ex. Angus Chemical Co. |
| DPA | 1-hydroxyethylene-1, 1,-diphosphonic acid (60% wt. actives) available as DEQUEST 2010 |
| Deionized water | deionized water |

Thereafter equal amounts of (a) aqueous alkaline compositions and the (b) aqueous acidic compositions were supplied to separate chambers of a dual-chamber bottle formed of a flexible thermoplastic material (high-density polyethylene, or HDPE), and which was further provided with a mixing nozzle which ensured good mixing of the exiting streams of the (a) aqueous alkaline composition and the (b) aqueous acidic compositions when they were dispensed from the dual-chamber bottle.

Evaluation of $Cl_2$ Gas Formed (I):

Equal quantities (40 grams) of each of the (a) aqueous alkaline compositions and the (b) aqueous acidic compositions were first supplied to separate chambers of dual-chamber bottles, and were subsequently expelled from the dual-chamber bottles containing the compositions to mix and initiate foaming, and applied to the interior inclined sidewall of a conventional toilet bowl.

The amount of a 'free chlorine gas' present in the interior of a toilet bowl was evaluated for each of the foamed hard surface compositions described on Table 1, at one or more time intervals indicated on Table 1 as well. The chlorine released from the foamed hard surface composition was sampled from the ambient air within the toilet bowl using OSHA Method ID-101 for "Chlorine in Workplace Atmospheres" Rev. May, 1991. First, a sample of the inventive composition was applied to the interior wall of conventional toilet bowl and thereafter the seat cover was closed upon the toilet seat installed on the toilet bowl. An inlet tube of a flexible material extended into the airspace within the interior of the toilet bowl and was inserted in a region at the front of the bowl (distal to the toilet tank) between the upper rim of the toilet bowl, and beneath the toilet seat. The inlet tube was connected to the inlet of a sampling pump, which drew the sampled air through an impinger containing a 0.1% sulfamic acid collection liquid at a draw rate of 1 liter per minute. Once the required amount of air has been sampled the collection liquid, containing the sampled chlorine is transferred into a suitable container to await analysis. Due to the presence of free oxygen which is collected with the chlorine, the ion selective electrode determination of chlorine specified in the OSHA Method ID-101 cannot be used. In the test, an inductively coupled plasma spectrometry (ICP) device (a Spectro "Ciros CCD" ex. Spectro Analytical Instruments, Inc., Fitchburg, Mass.) was used in place of the electrode specified in OSHA Method ID-01 as the ICP provided rapid, reproducible and very specific determinations of chlorine sampled; importantly the presence of oxygen did not interfere with the use of the ICP. Each sample of collection liquid was analyzed for chlorine by introduction into the ICP and the results were determined versus the appropriate standards at 134 nm. The ICP had a minimum quantifiable limit for chlorine below about 0.5 PPM in the presence of the sulfamic acid in the collection liquid and the results of the analysis were correlated to the amount of $Cl_2$ in the tested airspace within the interior of the toilet bowl. Amounts of chlorine gas less than 0.05 ppm were not reliably detectable, and are reported in Table 1 as "<0.05".

As reported on Table 1, the inventive compositions, particularly preferred embodiments of the inventive compositions, exhibited an exceedingly low formation of free $Cl_2$ gas.

Evaluation of $Cl_2$ Gas Formed (II)

In the performance of this test, certain of the example compositions described on Table 1 were evaluated for the amount of chlorine gas generated when the (a) aqueous alkaline compositions and the (b) aqueous acidic compositions used to form a mixture were combined in both equal, and unequal amounts. This test was performed in accordance with the protocol described immediately above except that differing proportions of the (a) aqueous alkaline compositions and the (b) aqueous acidic compositions were mixed to ultimately form one of several standard total mixture amounts, each of which is representative of the typical amount expected to be used by a consumer in the cleaning of a toilet. As recited above, equal or unequal quantities (40 grams) of each of the (a) aqueous alkaline compositions and the (b) aqueous acidic compositions were first dispensed from the separate chambers of dual-chamber bottles containing the compositions to mix and initiate foaming, and applied to the interior inclined sidewall of a conventional toilet bowl.

The amount of a 'free chlorine gas' present in the interior of a toilet bowl was evaluated in accordance with the protocol described above used to measure the amount of free $Cl_2$ gas for each of the foamed hard surface compositions at various time intervals as indicated on Table 3. As reported in the following Table 3, the inventive compositions, particularly preferred embodiments of the inventive compositions, exhibited an exceedingly low formation of free $Cl_2$ gas.

TABLE 3

[total amount of each mixture = 72 g]

| Example | Mix ratio (a):(b)[4] | Time after mixing | $Cl_2$ gas measured(ppm) following mixing of (a) + (b) at time after mixing |
|---|---|---|---|
| 18 | 1:1 | 30 min | 0.137 |
| 18 | 1:1 | 60 min | 0.097 |
| 18 | 1:1 | 30 min | 0.103 |
| 19 | 1:1 | 30 min | 0.106 |
| 19 | 1:1 | 60 min | 0.151 |
| 20 | 1:1 | 30 min | <0.05 |
| 20 | 1:1 | 60 min | <0.05 |
| 18 | 1.25:1 | 30 min | 0.126 |
| 18 | 1.25:1 | 60 min | 0.093 |
| 18 | 1.25:1 | 30 min | 0.072 |
| 18 | 1.25:1 | 60 min | 0.078 |
| 20 | 1.12:1 | 30 min | 0.084 |
| 20 | 1.12:1 | 60 min | <0.05 |
| 18 | 1:1.25 | 30 min | 0.138 |
| 18 | 4:1.25 | 30 min | 0.082 |
| 18 | 1:1.25 | 60 min | 0.070 |
| 19 | 1:1.18 | 30 min | 0.094 |
| 19 | 1:1.18 | 60 min | 0.074 |
| 20 | 1:1.12 | 30 min | 0.113 |

TABLE 3-continued

[total amount of each mixture = 72 g]

| Example | Mix ratio (a):(b)[4] | Time after mixing | $Cl_2$ gas measured(ppm) following mixing of (a) + (b) at time after mixing |
|---|---|---|---|
| 20 | 1:1.12 | 60 min | 0.105 |
| 20 | 1:1.18 | 30 min | 0.147 |
| 20 | 1:1.18 | 60 min | 0.216[5] |
| 21 | 1:1 | 30 min | 0.201[5] |
| 21 | 1:1 | 60 min | 0.100 |
| 21 | 1:1 | 30 min | 0.057 |
| 21 | 1:1 | 60 min | <0.05 |
| 21 | 1:1 | 30 min | <0.05 |
| 21 | 1:1 | 60 min | <0.05 |
| 21 | 1.25:1 | 30 min | <0.05 |
| 21 | 1.25:1 | 60 min | <0.05 |
| 21 | 1.25:1 | 30 min | 0.059 |
| 21 | 1.25:1 | 60 min | <0.05 |
| 21 | 1:1.12 | 30 min | <0.05 |
| 21 | 1:1.12 | 60 min | 0.056 |
| 21 | 1:1.12 | 30 min | <0.05 |
| 21 | 1:1.12 | 60 min | <0.05 |
| 21 | 1:1.18 | 30 min | 0.054 |
| 21 | 1:1.18 | 60 min | <0.05 |
| 21 | 1:1.18 | 30 min | 0.068 |
| 21 | 1:1.18 | 60 min | 0.063 |
| 21 | 1:1.18 | 30 min | 0.061 |
| 21 | 1:1.18 | 60 min | <0.05 |
| 21 | 1:1.25 | 30 min | 0.068 |
| 21 | 1:1.25 | 60 min | <0.05 |
| 21 | 1:1.25 | 30 min | <0.05 |
| 21 | 1:1.25 | 60 min | <0.05 |
| 21 | 1:1.25 | 30 min | <0.05 |
| 21 | 1:1.25 | 60 min | <0.05 |

[4]Mix ratio (a):(b) represents respective weight ratio of (a) aqueous alkaline compositions to (b) aqueous acidic compositions, with total amount of (a) and (b) providing the amount of each mixture indicated in the Table

[5]believed to be an erroneous reading

As is evident from the prior table, the inclusion of an excess of (a) aqueous alkaline compositions or (b) aqueous acidic compositions used to form each mixture did not, in most instances cause an undesirable excess of free $Cl_2$ gas to be formed. Such a feature is particularly advantageous in that precise and uniform mixing is not consistently required, e.g., as may often be occasioned by a consumer squeezing each of the chambers of a dual-chamber bottle such that the ratio of (a) aqueous alkaline composition or (b) aqueous acidic composition delivered from the bottle is unequal. Certain of the example compositions of Table 1 exhibited greater tolerance for such unequal mixing while at the same time, still providing minimum generation of free $Cl_2$ gas formed.

TABLE 3

| Example | Mix ratio (a):(b)[4] | Time after mixing | $Cl_2$ gas measured(ppm) following mixing of (a) + (b) at time after mixing |
|---|---|---|---|
| | [total amount of each mixture = 64.5 g] | | |
| 26 | 1:1.22 | 30 min | <0.05 |
| 26 | 1:1.22 | 60 min | <0.05 |
| 26 | 1:1.22 | 30 min | <0.05 |
| 26 | 1:1.22 | 60 min | ** |
| 26 | 1:1.22 | 30 min | <0.05 |
| 26 | 1:1.22 | 60 min | <0.05 |
| 26 | 1:1.22 | 30 min | <0.05 |
| 26 | 1:1.22 | 60 min | <0.05 |
| 26 | 1:1.22 | 30 min | <0.05 |
| 26 | 1:1.22 | 60 min | <0.05 |
| 27 | 1:1.22 | 30 min | 0.069 |
| 27 | 1:1.22 | 60 min | <0.05 |

TABLE 3-continued

| Example | Mix ratio (a):(b)[4] | Time after mixing | $Cl_2$ gas measured(ppm) following mixing of (a) + (b) at time after mixing |
|---|---|---|---|
| 27 | 1:1.22 | 30 min | <0.05 |
| 27 | 1:1.22 | 60 min | 0.060 |
| 27 | 1:1.22 | 30 min | <0.05 |
| 27 | 1:1.22 | 60 min | <0.05 |
| 27 | 1:1.22 | 30 min | 0.096 |
| 27 | 1:1.22 | 60 min | <0.05 |
| 27 | 1:1.22 | 30 min | <0.05 |
| 27 | 1:1.22 | 60 min | <0.05 |
| | [total amount of each mixture = 63 g] | | |
| 22 | 1:1 | 30 min | <0.05 |
| 22 | 1:1 | 60 min | <0.05 |
| 22 | 1:1 | 30 min | <0.05 |
| 22 | 1:1 | 60 min | <0.05 |
| 23 | 1:1 | 30 min | <0.05 |
| 23 | 1:1 | 60 min | <0.05 |
| 23 | 1:1 | 30 min | <0.05 |
| 23 | 1:1 | 60 min | <0.05 |
| 24 | 1:1 | 30 min | <0.05 |
| 24 | 1:1 | 60 min | <0.05 |
| 24 | 1:1 | 30 min | <0.05 |
| 24 | 1:1 | 60 min | <0.05 |
| 25 | 1:1 | 30 min | <0.05 |
| 25 | 1:1 | 60 min | <0.05 |
| 25 | 1:1 | 30 min | <0.05 |
| 25 | 1:1 | 60 min | <0.05 |
| 22 | 1:1.21 | 30 min | <0.05 |
| 22 | 1:1.21 | 60 min | <0.05 |
| 23 | 1:1.21 | 30 min | <0.05 |
| 23 | 1:1.21 | 60 min | <0.05 |
| 23 | 1:1.21 | 30 min | <0.05 |
| 23 | 1:1.21 | 60 min | <0.05 |

As is evident from the foregoing two Tables, the provision of an excess of the (b) aqueous acidic compositions with respect to the (a) aqueous alkaline compositions used to form each mixture did not, in most instances cause an undesirable excess of free $Cl_2$ gas to be formed. Such a feature is particularly advantageous in that precise and uniform mixing is not consistently required, e.g., as may often be occasioned by a consumer squeezing each of the chambers of a dual-chamber bottle such that the ratio of (a) aqueous alkaline composition or (b) aqueous acidic composition delivered from the bottle is unequal.

Evaluation of Antimicrobial Efficacy:

Foamed hard surface cleaning compositions described on Table 1 were evaluated for antimicrobial efficacy against several challenge organisms according to the protocols outlined in British Standard EN 13697:2001 for Chemical disinfectants and antiseptics—Quantitative non-porous surface test for the evaluation of bactericidal and/or fungicidal activity of chemical disinfectants used in food, industrial, domestic and institutional areas —Test method and requirements without mechanical action (phase2/step 2). This test method utilizes 4 bacteria (*Staphylococcus aureus*, ATCC 6538; *Escherichia coli*, ATCC 10536; *Enterococcus hirae*, ATCC 10541, and *Pseudomonas aeruginosa*, ATCC 15542) to demonstrate bactericidal activity on a test hard surface (i.e. 2 cm diameter stainless steel discs).

Bacterial cultures were grown on agar medium and harvested after the appropriate incubation and transfer series. The initial inoculum was adjusted to the required levels (1.5-5.0×$10^8$ organisms/mL for bacteria, 1.5-5.0×$10^7$ organisms/mL for fungi). Testing was performed at a temperature ranging between 18 and 25° C. At least 2 minutes before the start of the test, 1 mL of each adjusted test culture was added to 1 mL of interfering substance (i.e. 0.06% Bovine Albumin for clean conditions; 0.6% Bovine Albumin for dirty conditions). For each test organism, two test surfaces (replicates, or "Rep" in the following tables) were inoculated with 0.05 mL (50 μL) of the test organism/bovine albumin mixture. The challenge microorganism was spread over the surface of the disc, and allowed to dry for up to one hour at 37° C. After drying, 0.1 mL of the test substance was placed onto the test surface, ensuring that the dried inoculum was totally covered by the test substance. After a contact time of 5 minutes (15 minutes for the fungi), the treated disc was subcultured into a test tube containing 10 mL of neutralization media and 5 grams of sterile glass beads. The disc was agitated (shaker or vortex) to remove any surviving organism with the glass beads. Serial dilutions were performed, and the appropriate dilutions were plated. The above procedure was also performed for a control substance, namely sterile hard water. The test materials were incubated at 37° C. for over two nights. The agar plates were counted, and the number of organisms surviving on each disc was calculated. $Log_{10}$ values of these recoveries were determined. A neutralization assay was also performed for each test organism to demonstrate the neutralization of the active ingredient at the contact time. A reduction in viability was calculated for each test substance replicate by subtracting the $Log_{10}$ recovery value of the test substance from the $Log_{10}$ recovery value of the control substance replicate for each challenge microorganism. In order to be assigned a "PASS" score, a ≧4 log reduction must be achieved for each of the 4 bacteria to demonstrate bactericidal activity on surfaces.

A formulation formed from equal parts of (a) and (b) described more fully according to Example 7 was evaluated without further dilution against the four test bacteria according to EN 13697:2001 under "dirty conditions" as denoted above; the results are reported on following Tables A-D.

TABLE A

Antimicrobial efficacy against *S. aureus*

| Formulation | Contact Time | Rep 1 | Rep 2 | Averaged value | Result |
|---|---|---|---|---|---|
| Ex. 7 | 5 minutes | >6.55 | >6.41 | >6.48 | PASS |
| Ex. 7 | 10 minutes | >6.55 | >6.41 | >6.48 | PASS |
| Ex. 7 | 30 minutes | 5.65 | >6.41 | >6.03 | PASS |

TABLE B

Antimicrobial efficacy against *E. coli*

| Formulation | Contact Time | Rep 1 | Rep 2 | Averaged value | Result |
|---|---|---|---|---|---|
| Ex. 7 | 5 minutes | >5.56 | >5.56 | >5.56 | PASS |
| Ex. 7 | 10 minutes | >5.56 | >5.56 | >5.56 | PASS |
| Ex. 7 | 30 minutes | >5.56 | >5.56 | >5.56 | PASS |

TABLE C

Antimicrobial efficacy against *Ps. Aeruginosa*

| Formulation | Contact Time | Rep 1 | Rep 2 | Averaged value | Result |
|---|---|---|---|---|---|
| Ex. 7 | 5 minutes | >4.66 | >4.74 | >4.70 | PASS |
| Ex. 7 | 10 minutes | >4.66 | >4.74 | >4.70 | PASS |
| Ex. 7 | 30 minutes | 3.76 | >4.74 | >4.25 | PASS |

TABLE 4

| Antimicrobial efficacy against *E. hirae* | | | | | |
|---|---|---|---|---|---|
| Formulation | Contact Time | Rep 1 | Rep 2 | Averaged value | Result |
| Ex. 7 | 5 minutes | >6.73 | >6.69 | >6.71 | PASS |
| Ex. 7 | 10 minutes | >6.73 | >6.69 | >6.71 | PASS |
| Ex. 7 | 30 minutes | >6.73 | >6.69 | >6.71 | PASS |

A formulation formed from equal parts of (a) and (b) described more fully in Table 1 was evaluated without further dilution against the four test bacteria according to EN 13697: 2001 under "dirty conditions" as denoted above; the results are reported on following Tables E-H.

TABLE E

| Antimicrobial efficacy against *S. aureus* | | | | | |
|---|---|---|---|---|---|
| Formulation | Contact Time | Rep 1 | Rep 2 | Averaged value | Result |
| Ex. 16 | 5 minutes | 4.78 | >6.83 | >5.81 | PASS |

TABLE F

| Antimicrobial efficacy against *E. coli* | | | | | |
|---|---|---|---|---|---|
| Formulation | Contact Time | Rep 1 | Rep 2 | Averaged value | Result |
| Ex. 16 | 5 minutes | >6.04 | >6.04 | >6.04 | PASS |

TABLE G

| Antimicrobial efficacy against *Ps. Aeruginosa* | | | | | |
|---|---|---|---|---|---|
| Formulation | Contact Time | Rep 1 | Rep 2 | Averaged value | Result |
| Ex. 16 | 5 minutes | >6.82 | >6.82 | >6.82 | PASS |

TABLE H

| Antimicrobial efficacy against *E. hirae* | | | | | |
|---|---|---|---|---|---|
| Formulation | Contact Time | Rep 1 | Rep 2 | Averaged value | Result |
| Ex. 16 | 5 minutes | >6.77 | >6.77 | >6.77 | PASS |

As may be seen from the results indicated above, the inventive compositions exhibits good antimicrobial efficacy against known microorganisms commonly found in lavatory, kitchen and other environments.

Evaluation of Limescale Removal Efficacy:

The efficacy of an inventive composition to remove limescale was demonstrated by the following test.

Several pre-weighed marble cubes (measured in grams) were placed into 40 gram aliquots of the foamed test compositions described in more detail on Table 1. After 10 minutes, the cubes were removed, rinsed with deionized water, dried for 24 hours under moderate heat, and then allowed to return to room temperature before being weighed. This process was repeated for each test compositions with several marble cubes to establish the mass lost from the marble cubes due to immersion in the test compositions; the results from are indicated on the following Tables I and J.

TABLE I

| Ex. 12 | | | | |
|---|---|---|---|---|
| | Initial mass (g) | Final mass (g) | Mass lost (g) | % wt. loss |
| Cube 1 | 19.7309 | 19.7061 | 0.0248 | 0.126 |
| Cube 2 | 19.5522 | 19.5244 | 0.0278 | 0.142 |
| Cube 3 | 20.8828 | 20.855 | 0.0278 | 0.133 |
| Cube 4 | 19.6746 | 19.6515 | 0.0231 | 0.117 |
| | | | Average = | 0.130 |

TABLE J

| Ex. 15 | | | | |
|---|---|---|---|---|
| | Initial mass (g) | Final mass (g) | Mass lost (g) | % wt. loss |
| Cube 1 | 19.5073 | 19.4634 | 0.0439 | 0.2250 |
| Cube 2 | 19.8727 | 19.8271 | 0.0456 | 0.2295 |
| Cube 3 | 19.2660 | 19.2267 | 0.0393 | 0.2040 |
| Cube 4 | 19.3176 | 19.2792 | 0.0384 | 0.1988 |
| | | | Average = | 0.2143 |

TABLE K

| Ex. 16 | | | | |
|---|---|---|---|---|
| | Initial mass (g) | Final mass (g) | Mass lost (g) | % wt. loss |
| Cube 1 | 18.3143 | 18.2420 | 0.0723 | 0.3948 |
| Cube 2 | 18.8814 | 18.8174 | 0.0640 | 0.3390 |
| Cube 3 | 16.1141 | 16.0623 | 0.0518 | 0.3215 |
| Cube 4 | 19.2209 | 19.1653 | 0.0556 | 0.2893 |
| Cube 5 | 17.7578 | 17.7043 | 0.0535 | 0.3013 |
| | | | Average = | 0.3166 |

A comparative formulation, using an aliquot of a commercially available preparation, "BREF WC Duo-Power Gel" (ex. Henkel) was evaluated using the same test protocol recited above for the compositions according to the invention. The evaluation results of the comparative formulation are reported on the following Table C-1.

TABLE C-1

| BREF WC Duo-Power Gel | | | | |
|---|---|---|---|---|
| | Initial mass (g) | Final mass (g) | Mass lost (g) | % wt. loss |
| Cube 1 | 20.2195 | 20.1891 | 0.0304 | 0.1503 |
| Cube 2 | 19.6971 | 19.6727 | 0.0244 | 0.1239 |
| Cube 3 | 18.2367 | 18.1999 | 0.0368 | 0.2018 |
| Cube 4 | 19.7170 | 19.6847 | 0.0323 | 0.1638 |
| Cube 5 | 19.8059 | 19.7828 | 0.0231 | 0.1166 |
| | | | Average = | 0.1607 |

From the foregoing reported results, the inventive compositions exhibit limescale removal efficacy comparable to, and in certain preferred embodiments significantly superior to that of the commercially available preparation tested.

It is to be understood that, while the invention has been described in conjunction with the detailed description thereof, the foregoing description is intended to illustrate and not limit the scope of the invention, which is defined by the scope of the appended claims. Other aspects, advantages, and modifications are within the scope of the following claims.

The invention claimed is:

1. A two-part hard surface treatment composition which is formed by the admixture of two aqueous compositions, comprising:

(a) an aqueous alkaline composition comprising 0,1-10% wt. of a bleach constituent;

0.1-5% wt. of an alkaline constituent;

optionally 0.1-8% wt. of a gas releasing constituent;

0.1-3% wt. of an amine oxide nonionic surfactant; with, (b) an aqueous acidic composition comprising:

0.1-10% wt. of a peroxide constituent, 0.1-15% wt. of an acid constituent which includes sulfamic acid, which compositions are kept separate, but which are admixed immediately prior to use or upon use to form a foamed hard surface treatment composition, characterized in that:

the foamed hard surface treatment composition generates not more than 1 parts per million of chlorine gas when measured when measured during a 15 to 30 minute time interval within the first 60 minute interval following mixing of the (a) aqueous alkaline composition with the (b) aqueous acidic compositions, and wherein the formed hard surface treatment composition has a pH of 4 or less and demonstrates antimicrobial efficacy against one or more microorganisms selected from: *S.aureus, E.coli, Ps.aeruginosa,* and *E.hirae*.

2. A two-part hard surface treatment composition according to claim 1 which comprises a further detersive surfactant.

3. A two-part hard surface treatment composition according to claim 1 characterized in that the foamed hard surface treatment composition generates not more about 0.15 parts per million of chlorine gas when measured during a 15 to 30 minute time interval within the first 60 minute interval following mixing of the (a) aqueous alkaline composition with the (b) aqueous acidic compositions.

4. A two-part hard surface treatment composition which is formed by the admixture of:

(a) an aqueous alkaline composition comprising:

0.1-10% wt. of a bleach constituent;

0.1-5% wt. of an alkaline constituent;

optionally 0.1-8% wt. of a gas releasing constituent;

0.1-3% wt. of an amine oxide nonionic surfactant; and, (b) an aqueous acidic composition comprising:

0.1-10% wt. of a peroxide constituent, 0.1-15% wt. of an acid constituent consisting of sulfamic acid;

which compositions are kept separate, but which are admixed immediately prior to use or upon use to form a foamed hard surface treatment composition, characterized in that:

the two-part hard surface treatment composition generates a minimal amount of chlorine gas when formed and exhibits a cleaning benefit and a disinfecting or sanitizing benefit, is at an alkaline pH of 4 or less.

5. A two-part hard surface treatment composition according to claim 4 characterized in that the foamed hard surface treatment composition demonstrates antimicrobial efficacy against one or more microorganisms selected from: *S.aureus, E.coli, Ps.aeruginosa*, and *E.hirae*.

6. A two-part hard surface treatment composition according to claim 4 which is formed by the admixture of:

(a) an aqueous alkaline composition comprising:

0.1-10% wt. of a bleach constituent;

0.1-5% wt. of an alkaline constituent;

optionally 0.1-8% wt. of a gas releasing constituent;

0.1-3% wt. of an amine oxide nonionic surfactant; and, (b) an aqueous acidic composition comprising:

0.1-10% wt. of a peroxide constituent, 0.1-15% wt. of an acid constituent consisting of sulfamic acid;

which compositions are kept separate, but which are admixed immediately prior to use or upon use to form a foamed hard surface treatment composition, characterized in that the two-part hard surface treatment composition exhibits a cleaning benefit and a disinfecting or sanitizing benefit, and generates not more than about 1 parts per million chlorine gas when measured within a 15 to 30 minute time interval within the first 60 minutes following mixing of the (a) aqueous alkaline composition with the (b) aqueous acidic composition and, the formed composition is at a pH of 4 or less.

7. A two-part hard surface treatment composition according to claim 3 characterized in that the foamed hard surface treatment composition generates not more than about 0.10 parts per million chlorine gas, when measured during a 15 to 30 minute time interval within the first 60 minute interval following mixing of the (a) aqueous alkaline composition with the (b) aqueous acidic compositions.

8. A two-part hard surface treatment composition according to claim 7 characterized in that the foamed hard surface treatment composition generates not more 0.05 parts per million chlorine gas, when measured during a 15 to 30 minute time interval within the first 60 minute interval following mixing of the (a) aqueous alkaline composition with the (b) aqueous acidic compositions.

9. A two-part hard surface treatment composition according to claim 4 wherein the pH of the formed composition is at a pH of 3 or less.

10. A two-part hard surface treatment composition according to claim 9 wherein the pH of the formed composition is at a pH of 2.5 of less.

11. A two-part hard surface treatment composition according to claim 6 wherein the pH of the formed composition is at a pH of 3 or less.

12. A two-part hard surface treatment composition according to claim 11 wherein the pH of the formed composition is at a pH of 2.5 or less.

* * * * *

UNITED STATES PATENT AND TRADEMARK OFFICE

CERTIFICATE OF CORRECTION

PATENT NO. : 7,488,708 B2
APPLICATION NO. : 11/456321
DATED : February 10, 2009
INVENTOR(S) : Vesna Deljosevic et al.

It is certified that error appears in the above-identified patent and that said Letters Patent is hereby corrected as shown below:

In the Claims,

Column 31, Line 60, Claim 4, "is at an alkaline" should read -- and the formed composition at an acidic --.

Signed and Sealed this
Sixth Day of December, 2011

David J. Kappos

David J. Kappos
*Director of the United States Patent and Trademark Office*